US005854182A

United States Patent [19]

Swami et al.

[11] Patent Number: 5,854,182

[45] Date of Patent: Dec. 29, 1998

[54] METHOD FOR PRODUCING MAGNESIUM BORATE OVERBASED METALLIC DETERGENT AND TO A HYDROCARBON COMPOSITION CONTAINING SAID DETERGENT

[75] Inventors: Krishan Kumar Swami; Anurag Ateet Gupta, both of Faridabad; Shanti Parkash, Gurgaon; Madan Mohan Rai; Akhilesh Kumar Bhatnagar, both of Faridabad, all of India

[73] Assignee: Indian Oil Corporation Ltd., Mumbai, India

[21] Appl. No.: 728,052

[22] Filed: Oct. 9, 1996

[51] Int. Cl.[6] ..... C10M 159/24

[52] U.S. Cl. ..... 508/186

[58] Field of Search ..... 508/186

[56] References Cited

U.S. PATENT DOCUMENTS

| | | | |
|---|---|---|---|
| 3,829,381 | 8/1974 | LeSuer | 252/33.4 |
| 4,683,126 | 7/1987 | Inoue et al. | 508/186 |
| 4,965,003 | 10/1990 | Schlicht | 252/38 |
| 4,965,004 | 10/1990 | Schlicht et al. | 252/38 |
| 5,380,508 | 1/1995 | Inoue | 508/186 |

FOREIGN PATENT DOCUMENTS

| | | |
|---|---|---|
| 51-39702 | 10/1976 | Japan . |

*Primary Examiner*—Jerry D. Johnson
*Attorney, Agent, or Firm*—Spencer & Frank

[57] ABSTRACT

Magnesium borate overbased metallic detergent having magnesium borate uniformally dispersed in an extremely fine particle size is prepared by using magnesium alkoxide and boric acid. The process for preparation involves reacting neutral sulphonate of an alkaline earth metal with magnesium alkoxide and boric acid under anhydrous conditions in the presence of a dilution solvent followed by distillation to remove alcohol and part of dilution solvent therefrom. The borated mixture is then cooled, filtered to recover magnesium borated metal detergent. The magnesium borated metal detergent exhibited excellent cleaning and dispersing performance, very good hydrolytic and oxidation stability, good extreme pressure and antiwear properties. Such a detergent can advantageously be used in a hydrocarbon composition.

10 Claims, No Drawings

METHOD FOR PRODUCING MAGNESIUM BORATE OVERBASED METALLIC DETERGENT AND TO A HYDROCARBON COMPOSITION CONTAINING SAID DETERGENT

BACKGROUND OF THE INVENTION

1. Field of the Invention

This invention relates to a novel method for producing magnesium borate overbased metallic detergent and to a hydrocarbon composition containing said detergent.

2. Technology Background

U.S. Pat. No. 3,829,381 discloses a method which comprises reacting calcium carbontate overbased petroleum calcium sulphonate with boric acid in a mineral oil.

However, the dispersions of alkaline earth metal borate dispersions obtained by the aforesaid method has a low molar ratio of boron to alkaline earth metal in the entire dispersion and also have insufficient extreme pressure performance and corrosion preventing characteristics. Also, since the composition i.e. the dispersions containing the alkaline earth metal carbonate e.g. calcium carbonate, the particles of the carbonate of alkaline earth metal increase in size as the dispersion takes a longer time to be used and the total base number measured by the hydrochloric acid method is also lower than that measured by the perchlorate method.

Japanese Patent Laid-Open gazette No. 39702/76 discloses a method for producing a mixture of an alkali metal borate dispersion and an alkaline earth metal borate dispersion. In this method neutral sulphonate of an alkali or alkaline earth metal is allowed to react with an alkaline earth metal base and carbon dioxide gas in an inactive hydrocarbon solvent to form an overbased sulphonate which is then contacted with 2–6 parts in mole of boric acid per one part in mole of an alkaline earth metal carbonate which is present as the overbased alkali or alkaline earth metal sulphonate in an inactive oleophilic reaction medium to form an alkaline earth metal borate dispersion which is then contacted with an alkali metal base.

U.S. Patent assigned to Texaco Inc. (U.S. Pat No.4,965,003, 1990) discloses a process for preparing a borated, overbased metal detergent additive for lubricants which comprises dissolving a metal salt in a hydrocarbon solvent, adding a metal base and a polar solvent, treating with an acid gas, filtering the mixture to form a filtrate to which boric acid is added, heating the boric acid/filtrate mixture, stripping the cooled boric acid/filtrate reaction mixture and recovering the borated metal detergent additive therefrom. Another patent (U.S. Pat No. 4,965,004-1990) from the same company describes a process for preparing a borated, overbased metal detergent additive for lubricants which comprises borating an overbased metal salt in the presence of a protic solvent, distilling the borated metal salt mixture to remove protic solvent and water therefrom, cooling the distilled borated mixture, filtering the cooled borated mixture, stripling the cooled filtrate and recovering the borated metal detergent additive.

The prior art methods discussed above and the other related available literature, however, do not disclose a method for producing magnesium borate overbased metallic detergents using magnesium alkoxide and boric acid which exists as uniformly dispersed extremely fine particles without getting precipitated in the system during use.

SUMMARY OF THE INVENTION

It is an object of this invention to propose a novel method for preparing magnesium borate overbased metallic detergent dispersion.

Another object of this invention is to propose a method for preparing magnesium borate overbased metallic detergent having excellent cleaning and dispersing performance.

Still another object of this invention is to propose a method for preparing magnesium borate overbased metallic detergent for enhancing the oxidation stability of lubricants.

Yet another object of this invention is to propose a method for preparing magnesium borate overbased metallic detergent having good EP and antiwear properties.

A further object of this invention is to propose a process for the preparation of magnesium borate overbased metallic detergent having the aforesaid properties.

A still further object of this invention is to propose a hydrocarbon composition containing said detergent.

DETAILED DESCRIPTION OF THE INVENTION

According to this invention there is provided a process for preparing magnesium borate overbased metallic detergent additives comprising in the steps of:

i) preparing magnesium alkoxide by reacting a mixture containing a metal consisting only of magnesium under anhydrous conditions;

ii) reacting said magnesium alkoxide with a boron source in the presence of soluble neutral sulphonate of an alkaline earth metal and a diluent therefor to obtain said magnesium borate over based metallic detergent additive;

iii) removing the solvent by the step of distillation.

Further according to this invention there is provided a hydrocarbon composition comprising 0.5 to 10% of said magnesium borate overbased metallic detergent and remainder a hydrocarbon.

In accordance with this invention magnesium alkoxide is prepared under anhydrous conditions by reacting at 20° to 100° C. a mixture of 10–40 parts by weight of magnesium metal. 50–150 parts by weight of the respective alcohol, 0–1 to 1.0 parts by weight of an activation catalyst and 50–150 parts by weight of a diluent solvent. To this mixture is added 100 parts by weight of an oil-soluble neutral sulphonate of an alkaline earth metal, 10–50 parts by weight of boric acid and 0.8 to 1.5 times that of oil soluble neutral sulphonate by weight of a dilution solvent, and then heating the resulting reaction mixture to 100°–150° C. under reduced pressure ranging from about 10 to about 180 mm Hg to remove alcohol and a part of the dilution solvent as required.

The oil soluble neutral sulphonate of an alkaline earth metal used is an alkaline earth metal salt of any alkyl aromatic sulphonic acid having a molecular weight of about 300 to 1000.

Petroleum sulphonic acids and synthetic sulphonic acids are few examples of the alkyl aromatic sulphonic acids. The petroleum sulphonic acids used herein are prepared by sulphonation of alkyl aromatic compounds in the lubricant oil/mineral oil. The synthetic sulphonic acid comprises those prepared by sulphonating mono-and di-substituted alkyl benzenes. The substituents on benzene could be straight or branched alkyl group obtained as a by-product of a linear alkyl benzene manufacturing plant or through the alkylation of benzene with an olefin. Sulphonated alkyl naphthalenes such as sulphonated dinonyl naphthalene were also used. The alkaline earth metals used in this invention include magnesium, calcium and barium.

The neutral sulphonates of alkaline earth metals discussed herein are chemical equivalent salts of above described sulphonic acids and the alkaline earth metal salts. These are obtained, as a matter of example, by the direct reaction of an alkyl aromatic sulphonic acid and an aqueous hydroxide of an alkaline earth metal, or by carrying out reaction of an alkyl aromatic sulphonic acid with an aqueous hydroxide of an alkaline earth metal to form an alkaline earth metal sulphonate and then contacting the generated sulphonate with a salt like halide of an alkaline earth metal under heating.

The magnesium alkoxide used in this invention is prepared using C1–C8 mono-and dihydric-alcohols, glycol monoethers with straight and branched chains and their mixtures.

The catalyst in the reaction step of this invention is either Iodine, Mercuric chloride, para-Toluene sulphonic acid, Hydrochloric acid and ortho-Formic acid or their combination. The quantity of catalyst used in the reaction is 0.1 to 1.0 parts by weight, preferably 0.25 to 0.80 by weight, per 100 parts by weight of an oil soluble neutral sulphonate used in this invention. If the quantity of the catalyst used is less than 0.1 parts by weight, the total base number of the produced magnesium borate overbased metallic detergent will considerably be low. However, if the quantity of catalyst used exceeds 1.0 part by weight, the formation and dispersion of magnesium borate will not be uniform and also the particle distribution of the dispersed phase is undesirably uneven with low total base number.

Boric acid and boric oxide are used in the present invention for preparing magnesium borate, 10 to 50 parts by weight of boric acid is preferentially used in the present invention. The preferred concentration is however 20 to 45 parts by weight. Magnesium borate overbased metallic detergent having Mg/B compositional ratios of different range can be prepared by changing the concentration of boric acid in the present invention. If the quantity of boric acid is less than 10 parts by weight, the reaction between magnesium alkoxide and boric acid is not completed. On the other hand, if the boric acid exceeds the limit of 50 parts by weight, the boric acid will remain in the finished product unreacted which is undesirable for the process of present invention.

The dilution solvent used in this invention is an organic solvent having initial boiling point of 60° C. or more. The dilution solvents include benzene, toluene, xylene, petroleum ether, mineral spirit, gasoline, kerosene, cycle oil, high speed diesel (HSD) and different lubricant oil fractions of a mineral oil.

The quantity of total dilution solvent used in the present invention is 130 to 300 parts by weight, preferably 100 to 200 parts by weight, per 100 parts by weight of oil soluble neutral sulphonate. Decreasing dilution solvent quantity less than 130 parts by weight resulted into magnesium borate overbased metallic detergent with considerable high viscosity. However, if the quantity of the dilution solvent exceeds 300parts by weight the total base number of the magnesium borate overbased metallic detergent would be decreased.

In this invention magnesium alkoxide is prepared under strict anhydrous condition by reacting with efficient stirring at a reaction temperature of 20° to 100° C., preferably 40°0 to 90° C. According to the present invention, the reaction is well performed within the above reaction temperature range under atmospheric pressure. Although the reaction time largely dependent on the nature of alcohol, however, the normal range is 2 to 10 hours, preferably 3 to 8 hours. Finally in reaction step the reaction mixture is heated to 50° to 150° C. preferably 70° to 140° C. with efficient agitation and maintaining this temperature usually for 1 to 3 hours under reduced pressure ranging from 10 to 180 mm Hg preferably 50 to 150 mm Hg to remove alcohol and a part of the dilution solvent out of the reaction system. The quantity of dilution solvent removal is largely dependent on the end use application of magnesium borate overbased sulphonate.

According to present invention, as described above, anhydrous condition is maintained to obtain magnesium borate overbased sulphonate of desired high TBN value. The increase in the moisture content in the reaction step of the present invention drastically reduces the total base number (TBN) of the final product.

The particle size of magnesium borate overbased metallic detergent prepared by the method of this invention is 1000 Å or less, preferably 500 Å or less. One of the most important features of this invention is to obtained extremely fine particle of magnesium borate overbased metallic detergent.

In view of excellent cleaning and dispersing performance, very good hydraulic and oxidation stability, good extreme pressure and antiwear property of the magnesium borate overbased metallic detergent obtained by the method as herein described of this invention, the product can effectively be used as an additive for petroleum products such as fuels, lubricating oils, greases and as a rust preventive additive for a variety of applications.

EXAMPLES

Example 1

Under strict anhydrous condition, 14 parts by weight of magnesium metal is reacted with 50 parts by weight of methanol in presences of 100 parts by weight of a dilution solvent having a boiling range of 90 to 120 deg C. and 0.8 parts by weight of iodine under atmospheric pressure and at reaction temperature of 40 deg C. for 1 hour. The resulting reaction mixture was filtered and to the filterate is added 100 parts by weight of oil soluble synthetic neutral calcium sulphonate followed by 100 parts by weight of the dilution solvent as described above and 40 parts by weight of boric acid. The resulting reaction mixture was then heated to the temperature of 70 deg C. and maintained this temperature with efficient stirring for 3 hrs. The reaction mixture is filtered hot and the resulting filterate is heated to 130 deg C. under the reduced pressure to remove the solvents out of the reaction system. The content is then cooled and TBN is found to be 180 mg KOH/gm as per ASTH D-2896 (perchloric acid method). The magnesium borate in this magnesium overbased metallic detergent dispersion had an average particle size 120 to 180 Å. The magnesium borate overbased metallic detergent had the following elemental analysis:

| | |
|---|---|
| Mg: | 4.2% by wt |
| B: | 5.1% by wt |
| B/Mg | 1.21 (Molar ratio) |

Adopting the same reaction set up, mixing and work-up procedure of example 1. except changing the reactant composition and reaction conditions as follows:

| | |
|---|---|
| Neutral sulphonate: | 100 parts by wt |
| Magnesium metal: | 12 parts by wt. |
| Boric acid: | 38 parts by wt. |
| Alcohol: | 100 parts by wt |
| Dilution solvent: | 200 parts by wt |
| Reaction Temperature: | 70 deg C. |
| Reaction duration: | 4.5 hrs |

The TBN of the product was found to be 160 mg KOH/gm and the particle size in the range of 110–300 Å

Example 3

Employing same reaction set up and work-up procedure as described under example 1, except changing the reactant composition and reaction conditions as follows:

| | |
|---|---|
| Neutral sulphonate: | 100 parts by wt |
| Magnesium metal: | 15.5 parts by wt |
| Boric acid: | 40 parts by wt |
| Alcohol: | 100 parts by wt |
| Dilution solvent: | 200 parts by wt |
| Reaction temperature: | 70 deg C. |
| Reaction duration: | 4.5 hrs. |

The TBN of the product was found to be 189.9 mg KOH/gm with particle size ranging from 100–180 Å.

Example 4

Carrying out reaction using similar reaction set up and work-up procedure as described under example-1, except changing the reactant composition and reaction conditions as follows:

| | |
|---|---|
| Neutral sulphonate: | 100 parts by wt |
| Magnesium metal: | 22 parts by wt |
| Boric acid: | 42 parts by wt |
| Alcohol: | 100 parts by wt |
| Dilution solvent: | 200 parts by wt |
| Reaction temperature: | 60 deg C. |
| Reaction duration: | 4.5 hrs. |

The TBN of the product was found to be 105 mg KOH/gm and the size of the particle ranges between 190–480 Å.

Example 5

In the same reaction set up and adopting similar work-up procedure as described under example-1, except changing the reactant composition and reaction conditions as follows:

| | |
|---|---|
| Neutral sulphonate: | 105 parts by wt |
| Magnesium metal: | 18 parts by wt |
| Boric acid: | 44 parts by wt |
| Alcohol: | 120 parts by wt |
| Dilution solvent: | 200 parts by wt |
| Reaction temperature: | 80 deg C. |
| Reaction duration: | 4.5 hrs. |

The TBN of the product was found to be 174.4 mg KOH/gm with particle size ranging from 100–220 Å.

Example 6

Keeping the same reaction set up and adopting similar work-up procedure as described under example-1, except changing the reactant composition and reaction conditions as follows:

| | |
|---|---|
| Neutral sulphonate: | 105 parts by wt |
| Magnesium metal: | 18.7 parts by wt |
| Boric acid: | 44.0 parts by wt |
| Alcohol: | 120.0 parts by wt |
| Dilution solvent: | 200 parts by wt |
| Reaction temperature: | 70 deg C. |
| Reaction duration: | 4.5 hrs. |

The TBN of the product was found to be 171.2 mg KOH/mg with particle size ranging from 120–225 Å.

The detergency and dispersing Antioxidant, extreme pressure and antiwear performance of magnesium borate overbased metallic detergent obtained by the method of this invention can be demonstrated by different lab bench tests in mineral oil blends. In the blends, the required amount of magnesium borate over based metallic detergent by weight as produced in example-1 is added in 150N base oil so as to achieve total base number (TBN) of 6 mg KOH/gm for various experimentation to demonstrate the multifunctional characteristics as follows:

DETERGENCY PERFORMANCE

PANEL COKER TEST

The detergency efficacy of magnesium borate overbased metallic detergent w.r.t. base oil is assessed in term of as deposit forming tendency on rectangular Al-steel panel in Panel Coker test. In this test 200 ml sample is taken in sump and heated at 100 deg C. for 6 hrs. During this period the heated oil is splashed by whiskers on Al-steel Panel the temperature of which is maintained at 300 deg C. After completion of test deposit on panel (in mg) is measured. Incorporation of magnesium borate overbased metallic detergent of the present invention in base oil decrease the deposit of panel from 238.5 mg to 18.2 mg, as compared to deposit of 161.7 mg when conventional calcium carbonate over base detergent is used. This clearly demonstrates superior detergency action of the product of the present invention.

ANTIOXIDANT PERFORMANCE

PRESSURE DIFFERENTIAL SCANNING CALORIMETRY (PDSC)

The PDSC (Du Point Model-910/1090B) was used for relative antioxidant performance evaluation of the composition. In this test the sample (10.5 + or −0.5 mg) taken in a sample boat was subjected to heating from 100–300 deg C. at the rate of 10 deg C. per minute under 500 psi oxygen pressure. The onset of oxidation temperature (OBT) was adopted as a criteria for assessment of antioxidant performance. In general, the increase in onset of oxidation temperature indicates improvement in antioxidant performance. Addition of 2% w/w of magnesium borate overbased metallic detergent of the present invention to the lubricating oil base stock enhanced the onset of oxidation temperature by 12 deg C., which is indicative of better antioxidant characteristics of the product. At similar dosage the conventional calcium carbonate overbased detergent of same TBN enhanced the onset of oxidation temperature of the lube base stock by mere 5.6. deg C.

ANTIFRICTION AND ANTIWEAR PERFORMANCE

The antifriction and antiwear properties of the blends were measured by an oscillating friction and wear apparatus, SRV Test Rig. under point contact condition. The test conditions adopted for measurements are: Load, 300N; Temp. 50 deg C., Frequency, 50 c/s; Amplitude, 1 mm: Duration, 1 hr. The minimum stabilised value of coefficient of friction recorded during the continuous run was taken as criterion for friction whereas wear scar dia on the ball and wear scar depth obtained on the bottom disc specimen were taken as wear criteria. The percentage reduction/improvement with respect to base oil for the above tribological parameters was taken as a measure of performance of product prepared in the present invention. Considerable improvement in terms of wear scar dia, wear scar depth and coefficient of friction has been observed when magnesium borate overbased metallic detergent prepared in the present invention was added to 150N mineral base oil and compared to when conventional calcium carbonate overbased detergent was used at same concentration.

EXTREME PRESSURE PERFORMANCE

Extreme pressure performance of magnesium borate overbased metallic detergent was determined by measuring the weld load on a four-ball machine as per ASTH D-2783 test method. Enhancement of weld load to the tune of 60% was observed using the blend containing product as herein prepared. The enhancement in the weld load was only 40% when conventional calcium carbonate overbased detergent was used at the same concentration.

RUST PREVENTIVE PERFORMANCE

The rust preventive efficacy of the product of the present invention was assessed by ASTH D-1748 humidity cabinet test. The metallic panels were distinctly cleaner after 48 hrs when coated with oil containing the product of the present invention. Clear qualitative improvement of the metal panels by use of products of the present invention over the oils containing conventional calcium carbonated overbased additives was observed.

SPECIFIC ADVANTAGES OF THE PRODUCT OF THE INVENTION

According to the present invention as herein described in Examples 1 to 6, magnesium borate overbased metallic detergent having extremely fine particles of the magnesium borate uniformally dispersed can be obtained by using magnesium alkoxide and boric acid as ingredients for overbasing.

Further to it, the reactions are carried out under strict anhydrous conditions to obtain magnesium borate overbased metallic detergent of TBN as herein described in the present invention. The presence of moisture drastically reduces the TBN of final product.

As may be seen from the results of performance evaluation, the magnesium borate overbased metallic detergent obtained by the method of this invention has shown good to excellent performance characteristics as compared to conventional metal carbonate overbased detergent. This positively indicates that there are clear and remarkable differences in performance in the cases wherein magnesium borate overbased metallic detergent obtained by this invention is incorporated and those wherein the same is not added.

Additionally, the magnesium borate overbased metallic detergent, obtained by the method of this invention exhibited excellent cleaning and dispersing performance, very good oxidation stability, good extreme pressure and antiwear properties, and can be used for a variety of applications such as an additive for petroleum products e.g. in fuels, lubricating oils greases and as rust preventive agents in lubricants and paint pigments.

We claim:

1. A process for preparing magnesium borate overbased metallic detergent additives comprising in the steps of:

i) preparing magnesium alkoxide by reacting a mixture containing a metal consisting only of magnesium under anhydrous conditions;

ii) reacting said magnesium alkoxide with a boron source in the presence of soluble neutral sulphonate of an alkaline earth metal and a diluent therefor to obtain said magnesium borate over based metallic detergent additive;

iii) removing the solvent by the step of distillation.

2. The process as claimed in claim 1 wherein said magnesium alkoxide is prepared under anhydrous conditions by reacting at 20° to 100° C. a mixture of 10–90 parts by weight of magnesium metal, 50–150 parts by weight of a respective alcohol, 0.1 to 1.0 parts by weight of an activation catalyst and 50–150 parts by weight of a dilution solvent.

3. A process as claimed in claim 2 wherein said alcohol is selected from the group consisting of mono-and dihydric-alcohols, glycolmonoethers with straight and branched chain and mixtures thereof.

4. The process as claimed in claim 2 wherein said activation catalyst is selected from the group consisting of iodine, mercuric chloride, p-toluene sulfonic acid, hydrochloric acid and ortho-formic acid.

5. The process of claim 1 wherein step (ii) comprises reacting magnesium alkoxide in the presence of 100 parts by weight of an oil-soluble neutral sulphonate of an alkaline, earth metal, 10–50 parts by weight of boron source and 0.8 to 1.5 times that of oil soluble neutral sulphonate by weight of a dilution solvent.

6. A process as claimed in claim 1 wherein the boron source is selected from boric acid and boric oxide.

7. The process as claimed in claim 1 wherein the diluent of step (ii) is selected from the group consisting of benzene, toluene, xylene, petroleum ether, mineral spirit, gasoline, kerosene, cycle oil, high speed diesel (HSD), and different lubricant oil fractions of a mineral oil and mixtures thereof.

8. The process as claimed in claim 1 wherein the soluble neutral sulphonate of an alkaline earth metal is an alkaline earth metal salt of an alkyl aromatic sulphonic acid.

9. The process as claimed in claim 1 wherein, the alkaline earth metal of the soluble neutral sulphonate is magnesium, calcium or barium.

10. A process as claimed in claim 1 wherein said step of distillation is carried out at a temperature of 50° to 150° C.

* * * * *